United States Patent [19]

Thomason et al.

[11] Patent Number: 4,586,036

[45] Date of Patent: Apr. 29, 1986

[54] GRAPHICS DISPLAY SYSTEMS

[75] Inventors: Robert L. Thomason, Corona del Mar; Joseph C. Tipton, Fountain Valley, both of Calif.

[73] Assignee: Advanced Computer Concepts, Inc., Costa Mesa, Calif.

[21] Appl. No.: 470,455

[22] Filed: Feb. 28, 1983

[51] Int. Cl.[4] ..... G09G 1/00

[52] U.S. Cl. ..... 340/720; 340/721; 340/747; 324/88; 358/10; 358/139

[58] Field of Search ..... 340/720, 732, 744, 747, 340/799, 721; 358/139, 10; 324/88

[56] References Cited

U.S. PATENT DOCUMENTS

| | | | |
|---|---|---|---|
| 3,872,461 | 3/1975 | Jarosik et al. | 340/721 |
| 4,058,826 | 11/1977 | Schneider | 324/88 |
| 4,204,206 | 5/1980 | Bakula et al. | 340/721 |
| 4,307,393 | 12/1981 | Hamada et al. | 340/721 |
| 4,470,042 | 9/1984 | Barnich et al. | 340/721 |
| 4,484,187 | 11/1984 | Brown et al. | 340/721 |
| 4,484,302 | 11/1984 | Cason et al. | 340/721 |

OTHER PUBLICATIONS

"High Speed Raster Technique Provides Flexible Display", *Hewlett Packard Journal,* Nov. 1980, Stettiner et al, pp. 11-14.

*Primary Examiner*—Gerald L. Brigance

*Attorney, Agent, or Firm*—Blakely, Sokoloff, Taylor & Zafman

[57] ABSTRACT

Graphics display systems ideally suited for the display of certain types of graphics information are disclosed. The display systems utilize a black and white or color raster scan display having a vertical rather than a conventional horizontal raster scan. Data stored in the refresh memory of the display system is run length encoded so that a display pixel may be defined at any position along each vertical sweep of the raster scan or trace. Multiple channels allow the definition of multiple pixels on each scan, which allows the display of graph type data in a manner simulating the output of a multiple channel strip chart recorder. The system includes alphanumeric character generation and graphics character capabilities which allow the definition of grid lines and the labeling of information displayed. Methods and apparatus for providing windowing, panning, scrolling, horizontal compression, curve overlaying, panning of one curve with respect to other parts of the same curve or another curve, bar chart generation and other features and capabilities of the system are disclosed.

28 Claims, 17 Drawing Figures

TDI
TRI
128
TIE (TME)
PMI
INHI
122
124
Q
J
K
CLK
119
121
126
118
120
112
114
CAR
CTR
TIA
TIB
LD
E
THØ:18
LRIA
SCAN
CLK
LRIB 20
22
24
26
28
30
32
34

GRAPHICS DISPLAY SYSTEMS

BACKGROUND OF THE INVENTION

1. Field of the Invention

The present invention relates to the field of graphics display systems.

2. Prior Art

Various types of graphics display systems are well known in the prior art. Of particular interest to the present invention are graphics display systems usable for the display of graphics information presented in digital form. By way of example, sequential readings of some parameter may be taken in digital form, or in analog form and converted to digital form, typically over a period of time or with the variation of some other parameter, which information is then desired to be displayed in curve form as if the information had been recorded on a conventional strip chart. One type of prior art system commonly used for such purposes may be referred to as a bit mapped raster scan display system. For a black and white display there is a bit in memory corresponding to each pixel location on the display, with the information in memory being read out and displayed in synchronism with the raster scan. Thus in concept there is a one-to-one mapping between the memory and the display. If the display is to include gray shade capability or color capability also, additional planes of memory must be provided so that two or more bits of information are available for each pixel. Frequently such systems utilize bit map memories which are significantly larger than the area which can be displayed at any one time, with the portion of the memory displayable being controlled by the operator. In this manner the display may be allowed to pan (move horizontally) and scroll (move vertically) around the larger memory area.

Display systems of the foregoing type have the advantage that virtually anything within the resolution of the display system may be displayed, as every pixel of the display may be separately defined. They have certain disadvantages however, that make their use less than ideal in applications where the flexibility of being able to separately define each and every pixel on the screen is not required. Among such disadvantages, are that they require very large amounts of memory, particularly when gray shades or colors to be provided or when the memory is to be substantially larger than the high resolution display itself Also, because the memory is large, the time required to load or alter the image or images in memory is rather long, making such systems aggravatingly slow during certain operations.

Various types of data compaction techniques are known both for display and other purposes. By way of example, run time or run length encoding has been used for various purposes. In a particular display, one might define a solid shape on the display by toggling the display on when the raster crosses the left boundary and off again a length of time or high frequency count corresponding to the desired position of the right hand side of the defined shape. Other compaction techniques include the storage in memory of the left and right edge definitions of a solid shape, and toggling the display on when the left edge is crossed and off again when the right edge is crossed. Either of these techniques will allow the generation of a shape on the display much faster than a pure bit mapped system, as one is generally only working with the start and endpoints in one form or another and not each and every pixel therebetween. Such techniques have the disadvantage however, that the types of things that can be displayed using such techniques is highly limited. By way of example, in general run length encoding cannot be used in conventional raster scan systems to display the variation of one parameter with time or with another parameter in graph form, as the number of times of reoccurrence of the same value of y for varying time or other x coordinate parameter cannot in general be predetermined.

Conventional raster scan display systems, including TV receivers, utilize a horizontal raster scan wherein the display is defined by a plurality of horizontal lines, each defining the respective line of the overall image. Generally, a given image frame will be comprised of two successive interlaced fields, the first field being comprised of every other image line, and the second field being comprised of the remaining image lines of the frame physically positioned between the lines of the first field. Display systems have been built utilizing a vertical raster scan in certain limited special situations. Generally however, such systems are otherwise conventional, the vertical raster scan being used only as a consequence of rotating a conventional wider than tall display to achieve a display that is taller than it is wide.

BRIEF SUMMARY OF THE INVENTION

Graphics display systems ideally suited for the display of certain types of graphics information are disclosed. The display systems utilize a black and white or color raster scan display having a vertical rather than a conventional horizontal raster scan. Data stored in the refresh memory of the display system is run length encoded so that a display pixel may be defined at any position along each vertical sweep of the raster scan or trace. Multiple channels allow the definition of multiple pixels on each scan, which allows the display of graph type data in a manner simulating the output of a multiple channel strip chart recorder. The system includes alphanumeric character generation and graphics character capabilities which allow the definition of grid lines and the labeling of information displayed. Methods and apparatus for providing windowing, panning, scrolling, horizontal compression, curve overlaying, panning of one curve with respect to other parts of the same or another curve, bar chart generation and other features and capabilities of the system are disclosed.

BRIEF DESCRIPTION OF THE DRAWINGS

FIG. 11 is a block diagram of the trace control circuit used in the present invention.

DETAILED DESCRIPTION OF THE INVENTION

Figures 1, 2, 3, 10, 15, 16:
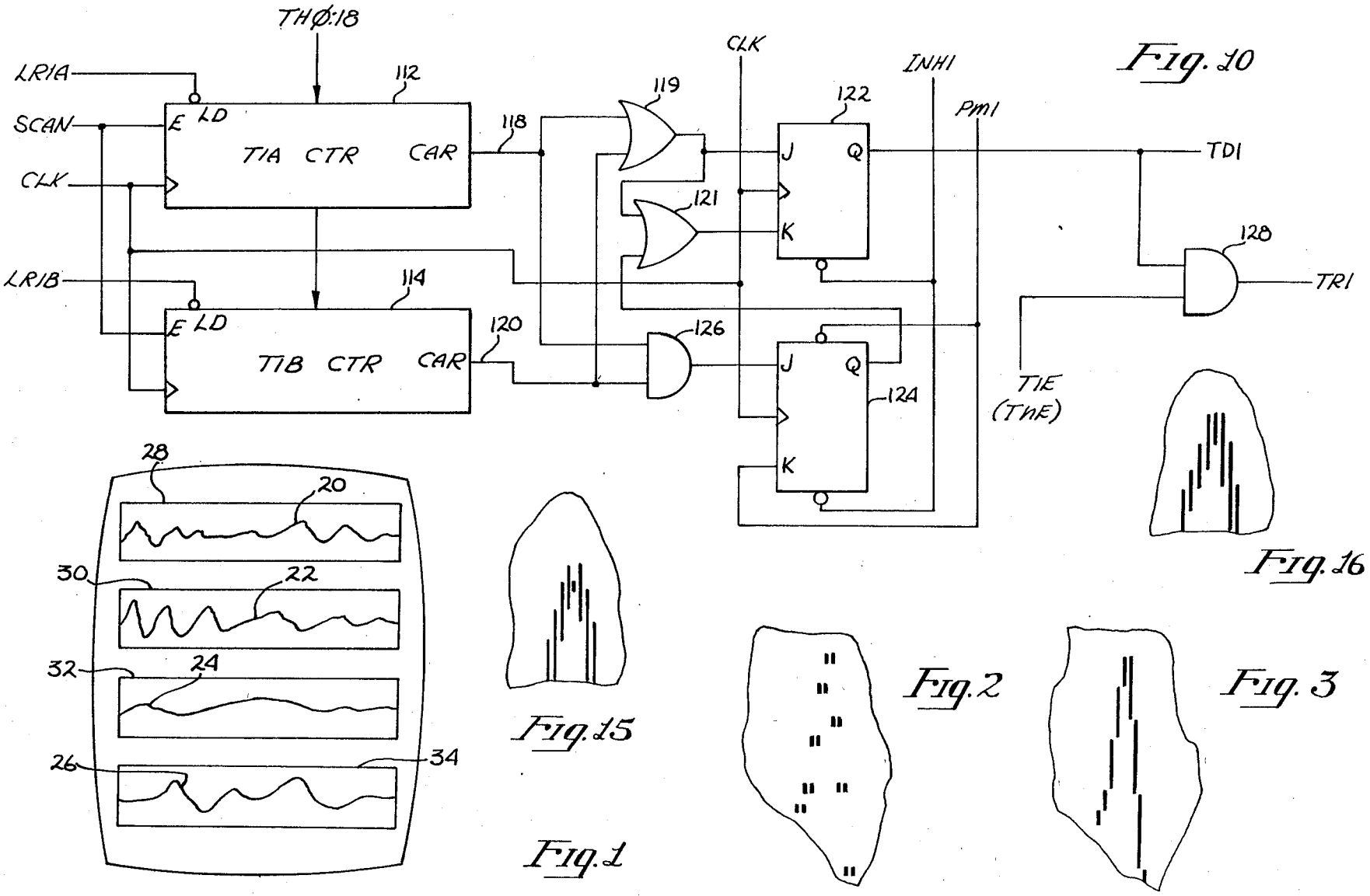
FIG. 1 is a schematic illustrating one form of display for the preferred embodiment of the present invention.
FIGS. 2, 3, 4, 5, 6, 7, 15 and 16 illustrate various details of typical graphics information which may be displayed using the present invention.
FIG. 10 is a detailed block diagram of the trace counters and output circuitry therefor to provide a typical trace signal.

The present invention is a graphics display system particularly suited for the presentation of certain types of graphical information in a highly efficient and easily manipulated manner. Because it represents a substantial departure from conventional graphics display systems, it is perhaps best to give an overview of the purpose and concepts of the invention prior to providing a detailed description of the preferred embodiment, as it is believed that such detailed description will be better understood and more illustrative after the concepts have already been set forth.

The present invention takes advantage of the characteristics of certain types of graphical information normally displayed in transient or permanent form such as on graph paper, strip charts and CRTs, whether displaying analog or digital information. In particular, one frequently displays the relationship of two or more variables in a simple x y plot. In the case of two variables, one variable is plotted against the other, whereas in the case of more than two variables one variable is plotted against a second for one or more values of the additional variable or variables. Normally the variable plotted in the x or horizontal direction is a monotonically increasing or monotonically decreasing variable, with the variable plotted in the y direction generally not being so controlled, and frequently repeated many times for different values of x. By way of specific example, the curve $y=x$ will be monotonically increasing, whereas the curve $y=1/x$ will be monotonically decreasing. On the other hand, the curve $y=\sin wt$ where t is plotted in the x direction, will have values of y in the curve repeated a number of times dependent upon the number of cycles plotted. For a graphics display system intended to plot data generally, one will not know ahead of time how many times a specific vertical value will repeat. Thus in general for displaying data in graph form there may be substantially any number of points on the graph for any one horizontal raster scan. On the other hand, since the horizontal axis of a conventional graph is a monotonic function, there will be only one graph point to be plotted for each horizontal position. Accordingly, the present invention takes advantage of that fact by using a vertical raster scan rather than the conventional horizontal raster scan. Thus for the display of data in graph form, only one data point per raster scan is needed for each curve to be plotted.

Since only one point per graph per raster scan is required, data compaction techniques may be used so that the amount of memory required to store the information to be displayed is grossly reduced over that required for conventional bit mapped raster scan systems. In the present invention, run length or run time encoding is used. In particular, the display itself is 720 viewable lines providing a potential width of 720 pixels. Each vertical raster scan line is divided into 512 pixels so that any point on a scan line can be identified by a nine bit binary number, i.e., 0 through 511. Actually, as shall subsequently be seen, the memory has a 12 bit storage capability for this purpose so that the curve stored in memory may be much higher than the part thereof which may be displayed at any one time.

Now referring to FIG. 1, an illustration of the type of display for which the present invention is particularly suited may be seen. The preferred embodiment is provided with four channels, which together allow the display of up to four curves, such as curves 20, 22, 24 and 26. The display itself is a long persistance color display having a screen size of approximately 12 inches high and 9 inches wide. Actually a conventional color display is used, though rotated 90 degrees so that what was originally the x sweep becomes the y sweep and the vertical retrace becomes the horizontal retrace. The display area is defined by 720 viewable vertical scan lines, each of which, as previously mentioned is divided into 512 pixels. The pixel rate is set so that each pixel has an aspect ratio of 2 to 1, each pixel being twice as high as it is wide.

For alphanumerics, the display area is broken into 80 columns and 42 rows, with each character having a $9\times12$ pixel size. Thus for alphanumerics, the entire 720 line display width is used, whereas the alphanumeric display height is 504 pixels. The character set in the preferred embodiment includes the full alphanumeric capability, plus additional selected graphics characters. These include horizontal lines which may be used in conjunction with vertical lines associated with the data itself to place a grid in the display area, and also include specially encoded horizontal and vertical lines or line segments which may be used to define the display windows 28, 30, 32 and 34. Since the size of each display window is defined through the character generator, in general the size of the windows is not predetermined, but may be altered in increments of the character size. In that regard the number of windows displayed in the preferred embodiment may be four or any lesser number than four, with up to all four curves being placed within any one window as desired.

In the point mode of operation of the present invention any one curve is displayed by displaying, for each vertical sweep, the individual point corresponding to the binary number stored in memory for that particular vertical sweep, together with the corresponding point for the previous sweep. Consequently each data point will be drawn twice, once on its "own" vertical sweep, and once at the same vertical position on the next sweep. Because of the 2 to 1 aspect ratio of each pixel, the resulting two side by side pixels will appear as a larger $2\times2$ or square "pixel". A portion of a curve drawn in the point mode may be seen in FIG. 2. For slowly varying data, points will appear somewhat connected, though in regions of rapidly varying data the points will appear unconnected and perhaps not define the curve as well as may be desired.

In another mode of operation, generally referred to as the plot mode, the points are effectively connected even in regions of rapidly varying data. In particular, instead of displaying individual points for each vertical sweep, line segments are drawn between these same two points per vertical sweep as in the point mode. In this mode, however, the ascending and descending line segments do not overlap at the start and stop points. This is accomplished by turning off the line segment one pixel short at the top of the line segment, thus each segment starts at the vertical location of the lower point and stops one pixel short of the vertical location of the higher point. Thus, each line segment will start at the lower of the previous point and the current point, and will end one pixel lower than the higher of these two points, drawing only a single point if the previous data value and the current Y data value are the same. This is illustrated in FIG. 3. These line segments are very easy to generate since there is no data manipulation required to convert the original plot data to screen display. Due to this simplicity, a plot can be generated on the fly, as the data for an upcoming vertical sweep can be accessed during the previous sweep retrace time. It is also simple to achieve considerable animation in the display. By way of example, using the exemplary screen size of 720 pixels wide by 512 pixels high, if there is a plot that has significantly more than the 720 points, it is very easy to display any 720 point segment of the plot by selecting the appropriate start address within the plot data base. This allows panning the plot to the right or to the left by changing the location of the plot starting position. It is also easy to scroll the plot up and down by adding or subtracting a bias to the start and stop points of each segment. In addition, zoom can be achieved rather simply. In the preferred embodiment, horizontal dezoom is also achieved by selecting either every plot point, every other plot point, every third plot point, etc. Vertical zoom can be achieved in two ways, either by use of a multiplier to scale each individual plot point or by the use of a variable clock to generate different spacing for each vertical pixel. These techniques of course are all separate and apart from software techniques that also could be used to achieve these functions by essentially rewriting panned and/or zoomed data, etc., into the display memory to achieve the desired function.

Figure 4:
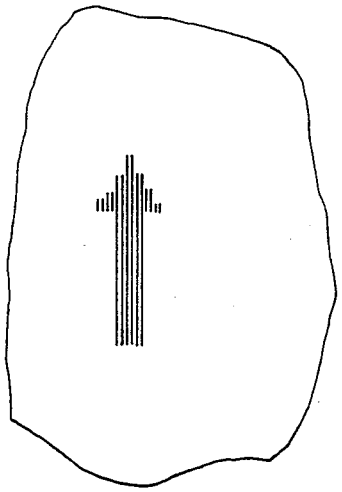

In addition to the normal plot and point modes discussed above, other modes are also available in the preferred embodiment of the invention. By way of example, in the double trace mode any given line segment is put up twice. This allows using two memory data values per double segment whereby the double trace can have a unique start and stop point unrelated to the previous double trace. This mode can be used for various purposes such as constructing spears, arrows or cursors as well as many other interesting figures, as may be seen in FIG. 4.

Figure 5:
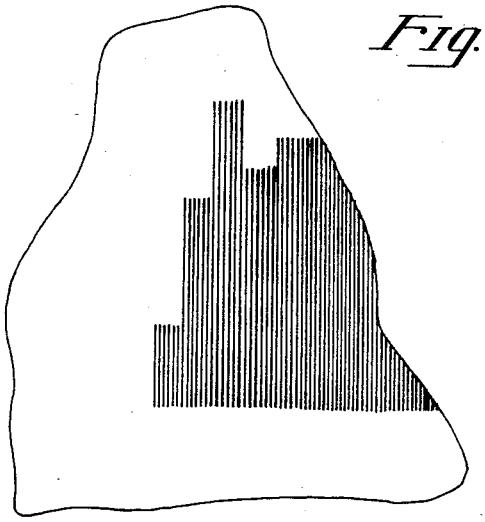
Figure 6:
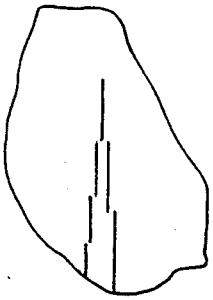

Also a no advance mode is provided whereby each line segment in this mode will have the same base location. In particular, in the normal plot mode each line segment is created by using the previous line's data point with the current line's data point to define the beginning and end of each segment. The no advance mode allows holding over a point from a line prior to the immediately preceeding line. This provides a number of interesting display characteristics including the ability to put up bar charts, histograms and point plots, as illustrated in FIG. 5. Also it allows the tailoring of plots such that one can create a single line peak or valley as illustrated in FIG. 6. This is to be compared with the normal plot mode wherein peaks and valleys are defined by double lines, as illustrated in FIG. 3, which result from the fact that the end of one line segment is the start of the next line segment in the normal plot mode. In FIG. 6, the end of the line two scan lines earlier is used as the start point for the next scan. Since the fields are interlaced, this becomes the end of the preceeding scan of the same field.

Figure 14:
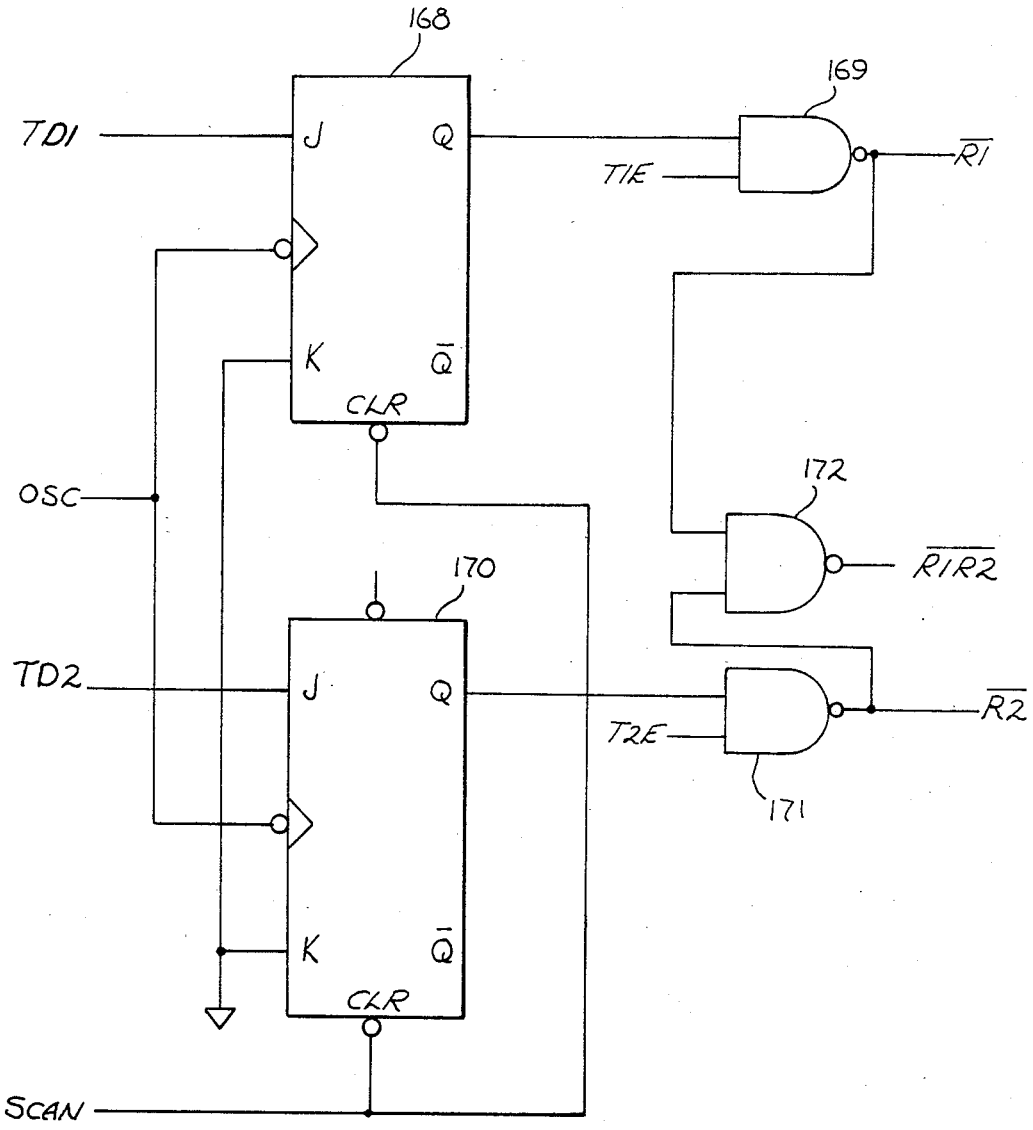
FIG. 14 is a circuit diagram for generating the signals used to provide the form of display illustrated in FIG. 7.

An additional double-trace mode is available which provides traces of double width lines, yet preserves the resolution of single width lines. This is accomplished by staggering the overlap of adjacent traces. In this mode, the start of the segment is not taken from the end of the previous segment, but instead is taken from the end of the segment prior to the previous segment. This is shown in FIG. 14. Note that the peak segment value will be repeated two lines over, and one line over from the peak there will be a gap equal to the difference between the peak and the top point of the segment prior to the peak. This can be eliminated as shown in FIG. 14 by setting the no-advance bit in the data word (to be subsequently described) for the line segment following the peak. This produces a three point peak. The same procedure will also produce three line valleys.

Figure 7:
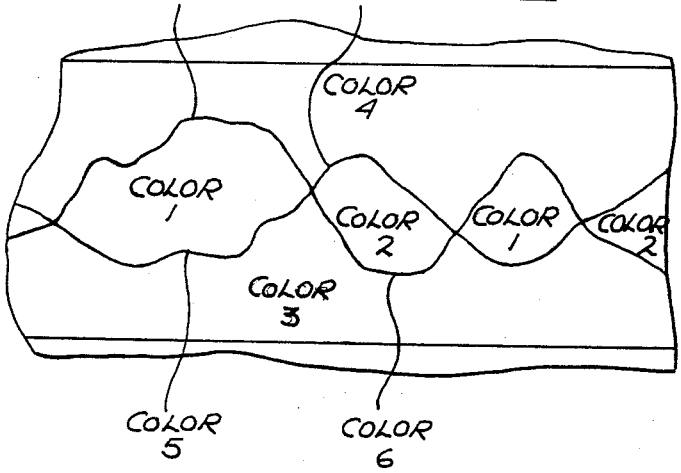

Finally an overlap mode is provided wherein special signals are developed which create additional segments filling the space between two or more plots. These segments are used to color code those areas where one plot is of greater value than another. In the preferred embodiment, color coding is provided which provides one color between plots when a trace is above another and a different color when the same trace is below the other, as is illustrated in FIG. 7, with another window background color below both traces and still another color above both traces.

The general technique for putting up graphs in accordance with the present invention has been outlined. As stated, in the preferred embodiment described herein, four channels are provided whereby four graphs may be put up at the same time, and in addition the system includes an alphanumeric character generator which includes certain graphics characters also to provide for window frame generation, cursor generation and grid line generation. In all, in the preferred embodiment there are 17 different sources of information, including color information, which are used to generate each pixel of the display. This is reduced to six bits of display data so as to allow the use of a minimal size look-up table for color selection. This is particularly advantageous, as six bits of information requires a look-up table of only 64 words whereas the 17 bits would require a look-up table of 131,072 words. As shall subsequently be seen, 15 of the 17 bits of information are collapsed through a special priority encoder to 4 bits with the additional 2 bits, which are color attributes from the character generator, being added directly to make up the 6 bits to form the input to the video look-up table.

Figure 8A:
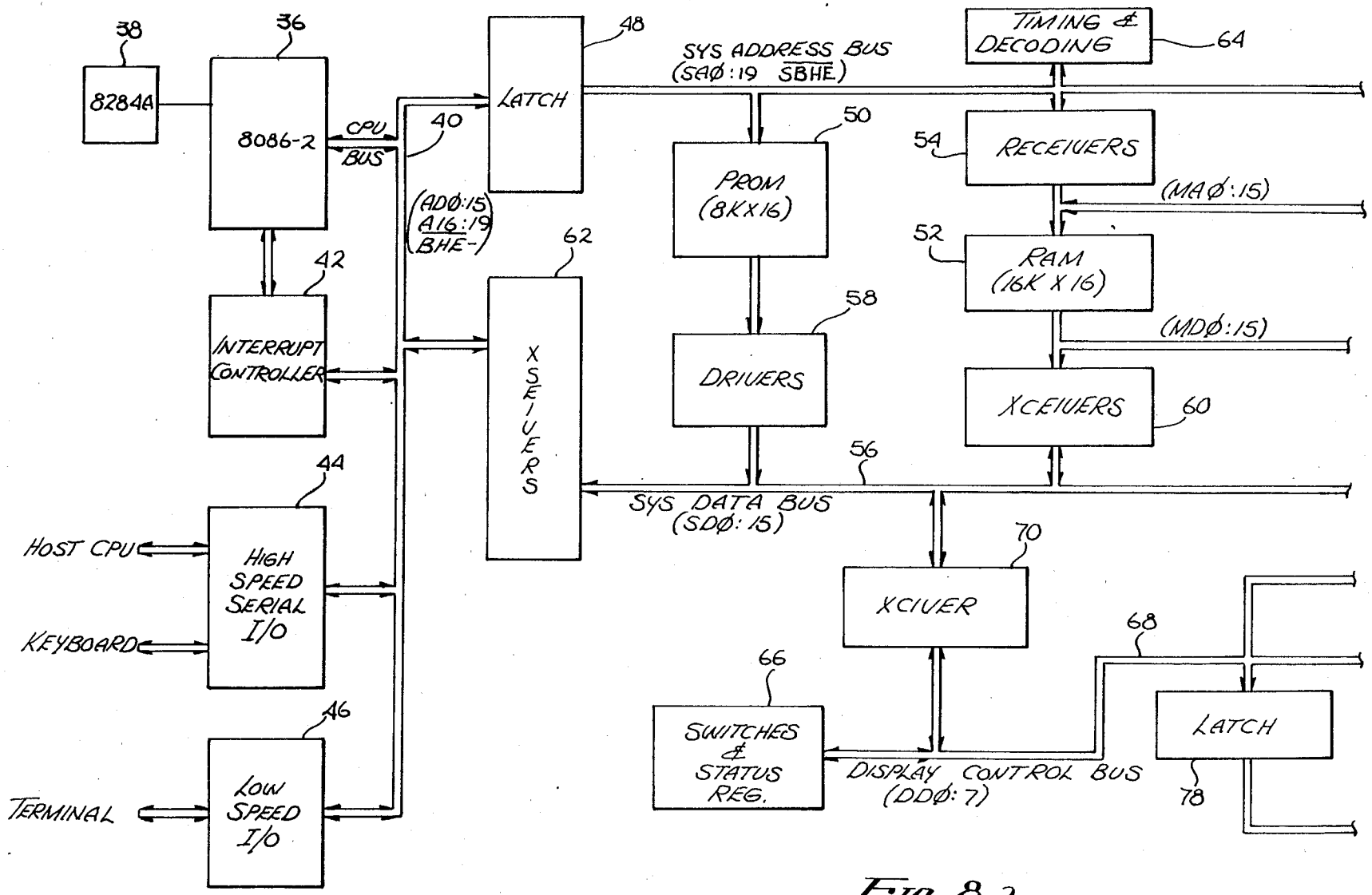
FIGS. 8*a* and 8*b* comprise the left portion and the right portion, respectively, of an overall system diagram for the preferred embodiment of the present invention.

Now referring to FIGS. 8(*a*) and 8(*b*), a block diagram of the display system of the present invention may be seen. FIG. 8(*a*) represents the left portion of the block diagram, and FIG. 8(*b*) the right portion, the two figures having been drawn on the same scale so that the two figures may be put together to form one overall figure for more convenient reference to the discussion to follow. In certain respects, the display system is conventional in that a number of aspects in the display system illustrated in FIGS. 8(*a*) and 8(*b*) may be found in prior art display systems and will appear familiar to those skilled in the art without excessive explanation. It is believed desirable however, to provide an overall explanation of the system, as that will provide a better reference for the detailed explanation of the differences between the present invention and the prior art. and the manner in which the differences result in an overall display system having many advantages over the prior art.

The preferred embodiment as depicted in FIGS. 8(*a*) and 8(*b*) utilizes an 8086-2 microprocessor 36 driven by an 8284A clock generator and driver 38 for control of the system through the microprocessor or CPU bus 40. Also coupled to the microprocessor bus is an 8259A interrupt controller 42 and 8274 high speed serial I/O port 44 and an 8251A low speed serial I/O port 46. All of the foregoing components are 8086 microprocessor family compatible components manufactured by Intel Corporation of Santa Clara, Calif. The central processing unit bus 40 is generally comprised of time multiplexed address and data lines AD0 through AD15, the four most significant address lines A16 through A19 and the byte high enable signal $\overline{BHE}$ characteristic of the 8086. The 20 bits of address may be latched in latch 48, comprised of three 74S373 octal latches, to provide addresses to the programmable read-only memory 50, to the random access memory 52 through receivers 54, and to the video lookup table 184 through receivers 188. The read-only memory in the preferred embodiment is comprised of a pair of 2764-3 memory devices, whereas the random access memory is comprised of sixteen 2164 64K memory devices, with the receivers 54 being a pair of 74S240's. As may be seen in the preferred embodiment, the output of the read-only memory is couplable to the 16 bit system data bus 56 through drivers 58, a pair of 74LS244's, with the output of the random access memory 52 also being couplable to the system data bus through transceivers 60, a pair of 74LS245's, and with the output of the video lookup table 184, also being couplable to the system data bus through drivers 190, a single 74 LS 240, though obviously not simultaneously, with the system data bus 56 being couplable to the CPU bus 40 through another pair of 74LS245 transceivers 62. The programmable read-only memory 50 provides permanent storage of the system operating program, which together with the timing and decoding circuit 64, provides the overall system control to accomplish the various system functions hereinafter described in detail.

In a typical system, control of the display system is provided through a keyboard coupled to the high speed I/O 44, with such control including the loading of data to be displayed into the random access memory 52 from a host computer also coupled to the I/O 44, and the controlling of window definition and zoom, etc., as hereinafter described. Also a terminal may be coupled to the system through the low speed I/O 46 so that system control through a terminal may be provided if desired.

The trace data stored in the random access memory 52 in the preferred embodiment is stored in order in individual trace lists in a particular format which defines not only the vertical trace coordinate for a scan line, but also defines additional information with respect to the display to be generated from that scan line. In particular, the least significant 12 bits describes in binary form the vertical trace coordinate for the scan line associated with that memory location, thereby defining trace coordinate values between 0 through 4095. The next bit defines the line (FIG. 3) or point (FIG. 2) mode, 0 representing the line mode and 1 representing the point mode. The next two bits are also mode bits, 00 representing the normal mode of starting at the end point of the last scan and ending at the defined point for the current scan, 01 defining the no advance mode (FIG. 5), 10 defining a blank or no draw mode for that trace and 11 defining the combination of blanking and no advance (which could be used by way of example to separate the bars in the bar chart of FIG. 5). Finally, the last or most significant bit defines the vertical grid element, a 0 calling for no grid element and a 1 commanding the drawing of a vertical grid element. Generally speaking, the trace coordinate will be received through the high speed I/O port 44 from the host computer, which data could include the plot information in the most significant 4 bits of the data word. Obviously however, the most significant 4 bits may be initially set and/or changed under control of the display system through the terminal or keyboard to change the modes and grid elements as desired. Also, while the display in the preferred embodiment is only 720 lines wide, a much larger storage capability is provided, each trace list in the preferred embodiment being arbitrarily set at 2800 words, i.e., 2800 vertical traces of which any 720 may be displayed at any one time. With ordinary display, 720 successive points from each trace list are displayed given a predefined starting point. Variations of that starting point, of course, will provide the desired pan function, the adding of a fixed offset to the vertical trace data will provide a scroll function and of course the displaying of every other trace data point, every third trace data point, etc., will provide varying degrees of horizontal compression. With respect to the pan function, it should be noted that the vertical grid element defined by the most significant bit in the trace data word effectively defines the vertical grid elements referenced to the trace data so that unless altered under software control, the vertical grid elements will pan with the displayed data as opposed to being stationary on the screen as a display data itself pans.

In addition to the trace data lists stored in the random access memory, the alphanumeric display data is also stored in that memory. In particular, as previously mentioned, the display area is 720 pixels wide by 512 high, with each alphanumeric character being 9 pixels wide by 12 pixels high, thereby defining an alphanumeric display area of 80 characters wide by 42 characters high. Each alphanumeric character in the $9\times12$ character space is a $7\times9$ character. The character words stored in the random access memory 52, of course, are stored as 16 bit character words, the first 8 (most significant) bits of which are straight ASCII characters. The next bit is unused. The next two bits are used for window identification, 00 being window 0, 01 being window 1, 10 being window 2 and 11 being window 3. The following two bits define the window frame elements, 00 being blank, 01 being a full character space underline used to define both the top and the bottom of each window, 10 being a full left side character border used to define both the left and right side of each window and finally, 11 being both an underline and a left side vertical border for the lower left hand corner of each window. Actually the 10 code border element having a window edge element on the left side of the character space is one pixel taller, i.e., 13 pixels high, achieved by appropriate timing in the character generator to fill in an otherwise blank pixel at the upper right hand corner of each window. Finally, the last three bits are used to define a three bit color table address.

The two bits defining the window frame elements as stated define graphics characters which, when positioned in the proper location, will define a window of the chosen size, whether it be substantially full screen for a single window presentation, something somewhat less than a half screen for a two window presentation, something less than a quarter screen for a four window presentation, or any other window size within the character size matrix and not overlapping another window. It will be noted that both the top and the bottom of each window are defined by the underlined character space with both the left and right sides of the window being defined by the character space having the left border thereof filled in, with the sole exception of the lower left corner of each window being described a character space having both underlining and left side lining therein. As previously described, the display or trace data words are stored in the random access memory in the form of trace lists, four trace lists being used in the preferred embodiment, which may be arbitrarily numbered 1 through 4. Each trace list represents one of the four channels of the display system. The status register 66 is used to maintain an identification of the specific window 0 through 3 in which data from each of the trace lists will be presented. Stated another way, data stored in the status registers 63 will provide a translation between trace list numbers and window numbers, as any trace may be displayed in any window number. The status register (and certain control switches) 66 are connected to the display control bus 68 and can be loaded under microprocessor control through 74LS245 transceivers 70.

A cathode ray tube controller 72, in the preferred embodiment an MC68A45-1 provides the line and pixel count required to address the random access memory 52 through receivers 74, a pair of 74S240s in the preferred embodiment, to provide the line count to the EPROM character generator 76 through a 74LS175 latch 78, and to provide horizontal and vertical video sync signals to the video output, specifically in the preferred embodiment to the digital to analog converter 80 for the green video signal. Thus as synchronized by the cathode ray tube controller 72, memory 52 is addressed through receiver 74 by the controller to provide the 16 bit character word hereinbefore described, the eight bit alphanumeric portion thereof being latched through 74LS374 latch 82 to form part of the address to the EPROM character generator 76, and the other 8 bits of the character word being latched in another 74LS374 latch 84 for subsequent shifting to a second 74LS374 latch 86 for presentation to the video priority selector 88. The cathode ray tube controller 72 also provides a four bit binary coded character line address to 74LS175 latch 78 to provide the character line address to the EPROM character generator 76. The output of the character generator, of course, is a 12 bit signal representing a 12 bit vertical slice through the respective $9\times12$ character, each slice through the character being counted off by the controller 72 to update the line address for each character on each sweep through latch 78. The output of the character generator 76 is provided to a shift register 90 comprised of a 74S194 and a 74LS299, to be shifted out at the pixel rate to the video priority selector 88, to be subsequently described.

One of the key aspects of the present invention is the trace control 94. As may be seen from FIG. 8, the trace control is synced to the cathode ray tube control 72 through the display control bus, and is provided with a direct memory access capability through 74240 receivers 96, the trace data words being addressed being provided to the trace control 94 through the same bus 98 also used as previously explained, to load latches 82 and 84.

Figure 9:
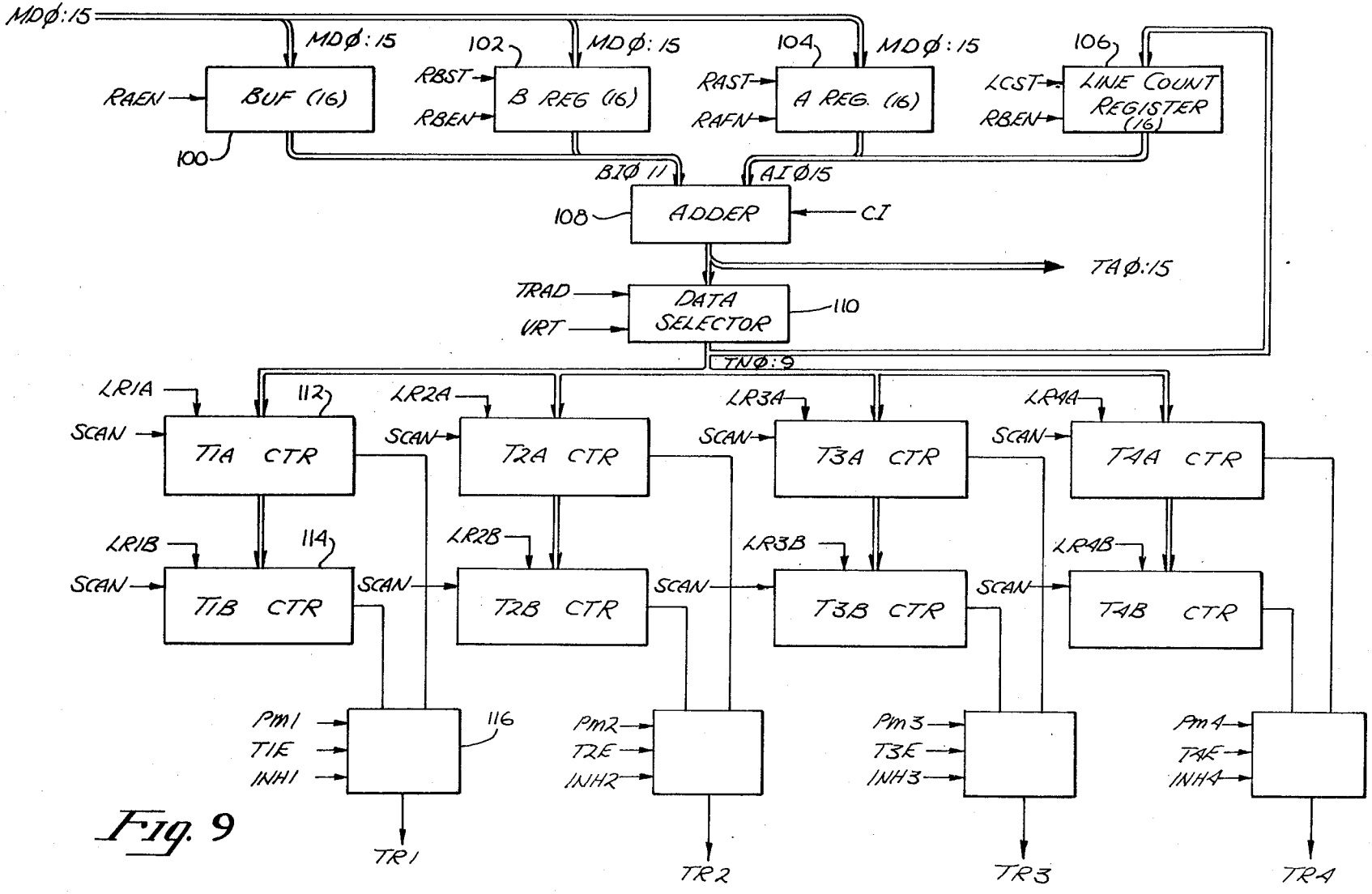
FIG. 9 is a block diagram of the trace processor of the present invention.
Figure 4:
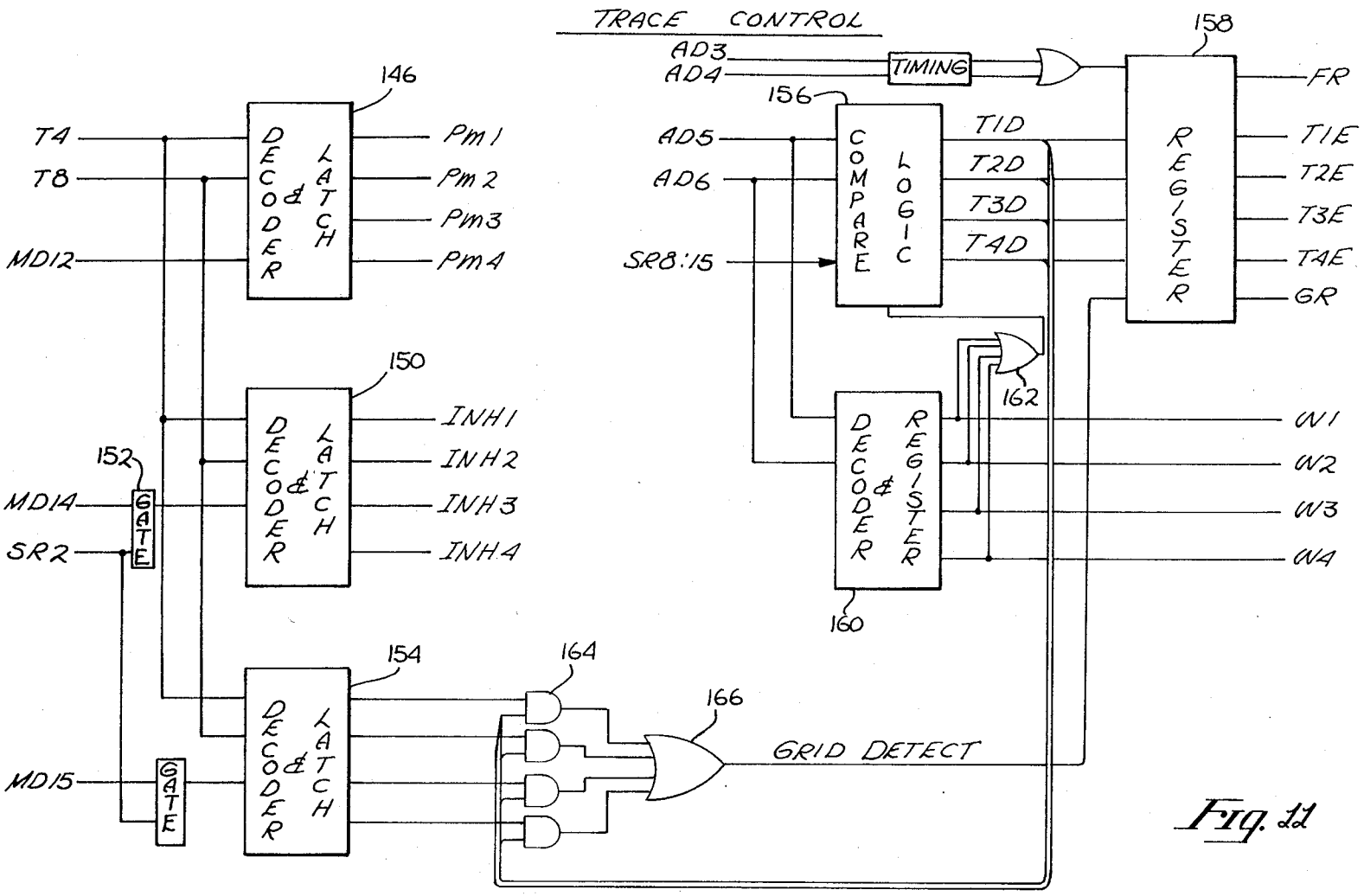

A detailed block diagram of the trace control 94 may be seen in FIG. 9. Data bus 98 is connected to a 16 bit buffer 100, a 16 bit register 102 referred to as the B register, and a 16 bit register 104 referred to as the A register. The circuit shown in FIG. 9 is responsible for accessing two constant for each of the four traces, and for addressing the correct data for each trace prior to each scan. One of the constants accessed is the offset value for each of the four traces. This is a constant in twos compliment form that will be added (or subtracted) to a trace data value to determine the vertical position of that trace for a particular scan, or upon change of that constant to effect a vertical scrolling movement of that trace. The second constant is the trace start address. As previously mentioned, trace data may be much greater than what can be displayed on the screen, in the preferred embodiment the screen having a width of 720 lines with the trace data being as high as 2800 lines. To be able to pan through this data, the data may be read out from different start address locations. For a stationary display this "pointer" will be the same for every scan and will be added to the line counter count which is incremented every scan line to allow sequencing through the specific block of trace data to be displayed. During every vertical retrace, the random access memory 52 is addressed to the trace control word for the first trace, and the vertical offset in the control word for the first trace is loaded into the A register. Then the trace address pointer is similarly loaded from memory into the B register, using the register B strobe signal RBST. Once this is accomplished, the line count register 106 and the B register holding the address pointer are added by the adder 108, the output of the B register and the line count register being enabled by the register B enable signal RBEN, to form the trace data address which is then sent to the random access memory on the lines TA0:15 by the trace address enable signal TRAD. Once the data returns from memory it is passed through the buffer 100 by the register A enable signal RAEN, which of course also enables the output of A register 104 so that these two signals are added by the adder to provide the offset trace value which is then passed to the data selector 110. In the preferred embodiment, the data selector inverts the data and transfers the data value to a trace counter which will be counted up to create trace segment timing. In addition, the data selector looks at the upper bits of the adder to determine whether or not the computed point for the trace is below the viewable portion of the screen or above the viewable portion of the screen. If the data value for the trace is less than 0, then the data TNO:8 is forced to all 1s by the data selector. If the value of the data point is greater than 511, then the data selector forces the output TN0:8 to all 0s. On horizontal retrace for even fields the data selector is forced to a 0 which is then loaded into the line counter to reset the line counter. On horizontal retrace for odd fields a 1 is forced into the lower order position of the line counter, thereby offsetting the trace data by one line between even and odd fields.

After the trace data for the first trace has been obtained from memory and added to the offset in the A register of the adder 108, the data is brought through the data selector 110 to the trace counter T1A identified by the numeral 112 in FIG. 9, being parallel loaded into the register by the load register on A signal LRIA. Thereafter the same process is repeated, though when the contents of register B and the line count register are added together to provide the trace data address, the carry input CI of adder 108 is held high so that the trace data address now obtained is one memory location higher than before. The contents previously loaded into trace counter T1A is parallel loaded downward into trace register T1B identified by numeral 114 in FIG. 9 through the load register 1B signal LR1E, so that upon loading the new trace data into trace counter T1A, the trace data with the desired vertical offset for the current line count as referenced to the start address of register B is loaded intc trace counter T1B, and the corresponding trace data for the next memory address and thus the next scan line is loaded into trace counter T1A. This same process is again repeated for the remaining three pairs of trace counters in the same manner described, so that the desired run length encoded trace data values for the current scan line for the four channels are loaded into the four B trace registers, and the corresponding trace data values for the next scan line are loaded into the four corresponding A trace registers.

A more detailed circuit diagram of the trace counters and the output logic 116 to form the trace outputs TR1 through TR4 may be seen in FIG. 10, which is a detailed circuit diagram of the trace counters and output logic for one channel, specifically the first channel. The counters 112 and 114 are nine bit counters which are loaded by the signals LR1A and LR1B respectively, connected to the load signal terminal thereof. The counters of course are clocked counters, clocked at the pixel rate, with the enable signal SCAN being active during the viewable 512 pixel time of each raster scan (the circuitry for providing the required timing signals referred to in FIG. 10 as well as in FIG. 9 shall hereafter be described). As previously mentioned, the counters count up from the particular (inverted) value loaded with each one, generating a carry signal when counting from all 1s back to all 0s. The carry signals on lines 118 and 120 from counters 112 and 114 are provided to the OR gate 119. The output of the OR gate is taken directly to the J input of flip-flop 122 and to the K input of the same flip flop via OR gate 121. This will cause the flip flop 122 to toggle and produce the scan line segment. The Q output of this flip-flop is taken to the AND gate 128 where it is ANDed with the trace enable signal T1E to form trace one segment timing signal TR1. The carry signals on lines 118 and 120 are also taken to an AND gate 126 where coincident carries will be detected. The output of AND gate 120 is taken to the J input of flip flop 124. The Q output of flip flop 124 is taken to the OR gate 121 which drives the K input of flip flop 122. This provides immediate turn off of flip flop 122 in the event of coincident carries, allowing flip flop 122 to be on for only 1 pixel time. The inhibit signal INH1, is taken to the reset inputs of both flip flops 122 and 124 and prevents either flip flop from being turned on when INH1 is active. The point mode control line, PM1, drives the DC set input and the K input of flip flop 124. When the point mode signal, PM1, is active (at the 0 level), flip flop 124 will remain high constantly and, thus, by its Q output will continuously enable the K input of flip flop 122, allowing flip flop 122 to be on for only 1 clock time (1 pixel time) for each carry output from counters 112 and 114. As shall subsequently be seen a trace enable T1E is active whenever the raster scan is within its designated trace window, as defined by the decoding of the 16 bit alphanumeric word, also fetched from the random access memory as each character cell boundary is crossed. In particular, it will be recalled that the 16 bit character word includes not only the 8 bit ASCII character set, but also includes 8 additional bits, two of which are window identification bits and two of which effectively identify the window boundary. The first crossing of a character cell boundary into the start of a graphics character having a full lower cell line indicating a window boundary toggles a flip-flop indicating that the trace is within that window, and on the second crossing of a character boundary having a full graphics character underline again toggles the flip-flop to indicate that the scan is no longer in that window. (Thus in the embodiment being described, the windows cannot be overlapping, as the logical realization being described in detail herein requires that the scan leave one window before a second can be entered.)

Figure 12:
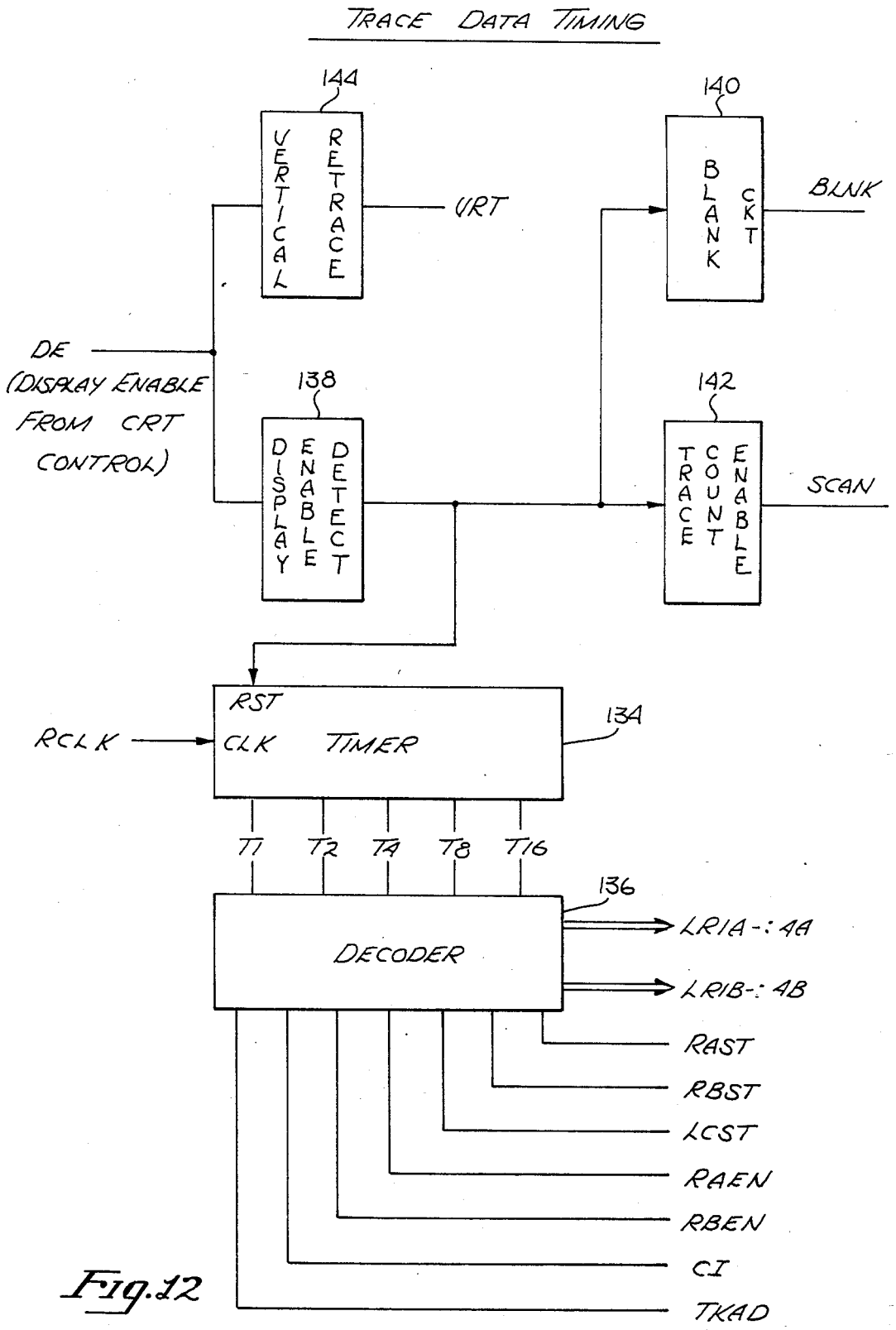
FIG. 12 is a block diagram of the trace data timing circuit of the present invention.

Now referring to FIG. 12, a block diagram of the trace data timing system may be seen. A timing circuit 134 provides timing signals T1, T2, T4, T8 and T16, basically as binary coded timing signals utilizing the signal RCLK being one of the timing signals used to identify 12 pixel times which make up one character time on the display. The timing signals T1 through T16 in turn are decoded by a decoder circuit 136 to provide various timing signals already described, principally with respect to FIGS. 9 and 10. In particular, the decoder 136 provides the load register A and load register B signals LR1A through LR4A and LR1B through LR4B in timed sequence. In addition, register A and register B store signals RAST and RBST are provided, as well as the line counter store signal LCST. Similarly the output enable signals for registers A and B, specifically RAEN and RBEN are provided, as well as the trace constant address timing signal TKAD. The timer 134 is reset by a display enable detect signal derived from the display enable signal DE, which is one of the outputs of the CRT control chip 72 hereinbefore identified with respect to FIG. 8*b*, the display enable detect signal being derived from the DE signal by the detect circuit 138. The display enable detect output of circuit 138 is also used by a blanking circuit 140 to provide the blanking signal BLNK and to a trace counter enable circuit 142 to provide the trace county enable signal SCAN. Finally, the display enable signal DE is also used by a vertical retrace circuit 144 to provide the vertical retrace signal VRT.

Now referring to FIG. 11, details of the trace control logic used to provide various trace control signals hereinbefore referred to may be seen. In the preferred embodiment, timing signals T4 and T8 of the timer 134 of FIG. 12, when decoded, are synchronized with the trace data words being fetched from random access memory 52 (FIG. 8*a*) as a 16 bit trace MD0:15 for each of the four traces. In that regard it will be remembered that the lower order bits MD0:11 represent the binary coded vertical trace coordinate for that trace, with MD12 designating the line or point mode. As may be seen in FIG. 11, the signals PM1 through PM4 are generated by the decoding of T4 and T8 by a decoder, and latching the state of MD12 into the respective latch of decoder and latch 146 based on that decoding. Similarly MD14 of the trace data word is the blanking bit, with the value of MD14 being latched into the respective latch of decoder and latch 150 as also determined by the decoding of T4 and T8. However the blanking bit MD14 is also gated with the second bit of the status register by gate 152 so that the inhibit signal will depend upon the state of both the second bit in the status register and MD14 commanding an inhibit, i.e., the second bit in the status register can be used as an override to command the inhibit. Similarly the data bit MD15 commands the drawing of a grid element, which again after gating with the status register bit SR2, is latched into decoder and latch 154 as indicated by the decoding of T4 and T8.

Also shown in FIG. 11 is the circuit for providing the trace enable signals T1E through T4E. In particular, bits 5 and 6 of the 16 bit alphanumeric character words, specifically AD5 and AD6, as previously mentioned contain the current window identification information. The status register bits SR8 through SR15 are initially set to provide the data/trace window relationships. In particular bits SR8 and SR9 are initially loaded with a two bit binary number identifying the window into which the first trace is to be displayed, SR10 and SR11 identifying the window in which the second trace is to be displayed, etc. When the alphanumeric data bits AD5 and AD6 correspond with status register bits SR8 and SR9, the compare logic 156 will enable the signal T1D which, when latched into register 158, will provide the trace 1 enable signal T1E. If the status register bits SR8 and SR9 indicate that the first trace should be in the third window, T1D will not be enabled until or unless the alphanumeric character word bits AD5 and AD6 (as latched in latch 84 of FIG. 8*b* and updated as the scan enters each new character cell) indicates that the scan is currently in the third window. Thus it may be seen that the trace enable signals T1E through T4E are not tied to any specific window but rather are tied to specific traces as a result of hardware, specifically that of FIGS. 9 and 10, and may enable any trace in any designated window as desired, including more than one trace, or in fact all traces in the same window if desired.

The two bits AD5 and AD6 are also decoded and the decoded signal latched in the decoder and register combination 160 to provide the signals W1 through W4 to indicate when the scan is within the respective window (these signals are used by the priority selector yet to be described). The signals W1 through W4 are also combined through OR gate 162 to provide the WIN signal used to enable the compare logic 156, as none of the trace enable signals T1E through T4E (or the signals T1D through T4D) should be active unless or until the scan is within one of the windows.

The output of the compare logic 156 is also coupled to provide one of the two inputs to each of the AND gates 164, the other input of which is the output of the decoder and latch 156. The outputs of the AND gates 164 are ORed by OR gate 166 to provide a grid detect signal latched in register 158 to provide the signal GR. Since the bit MD15 in the 16 bit trace data word defines whether or not there will be a vertical grid element for that trace, the decoding of T4 and T8 (effectively indicating the current trace number) and the gating of that signal through gates 164 and 166 as controlled by the output of the compare logic 156 makes the signal TR active whenever the scan is within the window to which that trace is assigned, as set by the status register bits SR8:15. Finally the window frame signal FR is provided through register 158, after timing and gating of the window frame bits AD3 and DD4.

Now referring to FIG. 14, a circuit diagram for the generation of reference signals used to achieve the feature described with respect to and illustrated in FIG. 7 may be seen. The trace signals TD1 and TD2 (See FIG. 9) are each applied to the J input of one of a pair of JK flip-flops 168 and 170, the K inputs thereto being tied to ground. The Q outputs of the two flip-flops are each coupled as one of the inputs to NAND gates 169 and 171, respectively, the other input to the NAND gates being coupled to the respective one of signals T1E and T2E. The outputs of NAND gates 169 and 171 are coupled as the two inputs to NAND gate 172 having inverted inputs. The intended signals to be derived from this circuit are the signals $\overline{R1}$ from the output of NAND gate 169, $\overline{R2}$ from the output of NAND gate 171 and the output of NAND gate 172. The flip-flops 168 and 170 are clocked by the clock signal OSC hereinbefore described. When one of the signals TD1 or TD2 becomes active in the plot mode, the respective JK flip flop will be set, driving the respective Q output thereof high, and if and when the scan is within the window indicated by T1E or T2E being high, $\overline{R1}$ or $\overline{R2}$ will go low, as the case may be. When the other trace signal becomes active, the other flip-flop will be set, driving the other Q output high, so that now both $\overline{R1}$ and $\overline{R2}$ are low. Also at this time, since both flip-flops are now set, both inputs to NAND gate 172 are low, making $\overline{R1R2}$ low. Finally, it will be noted that both flip-flops are cleared when the signal SCAN is low. In essence this resets the circuit for each scan.

Figure 8B:
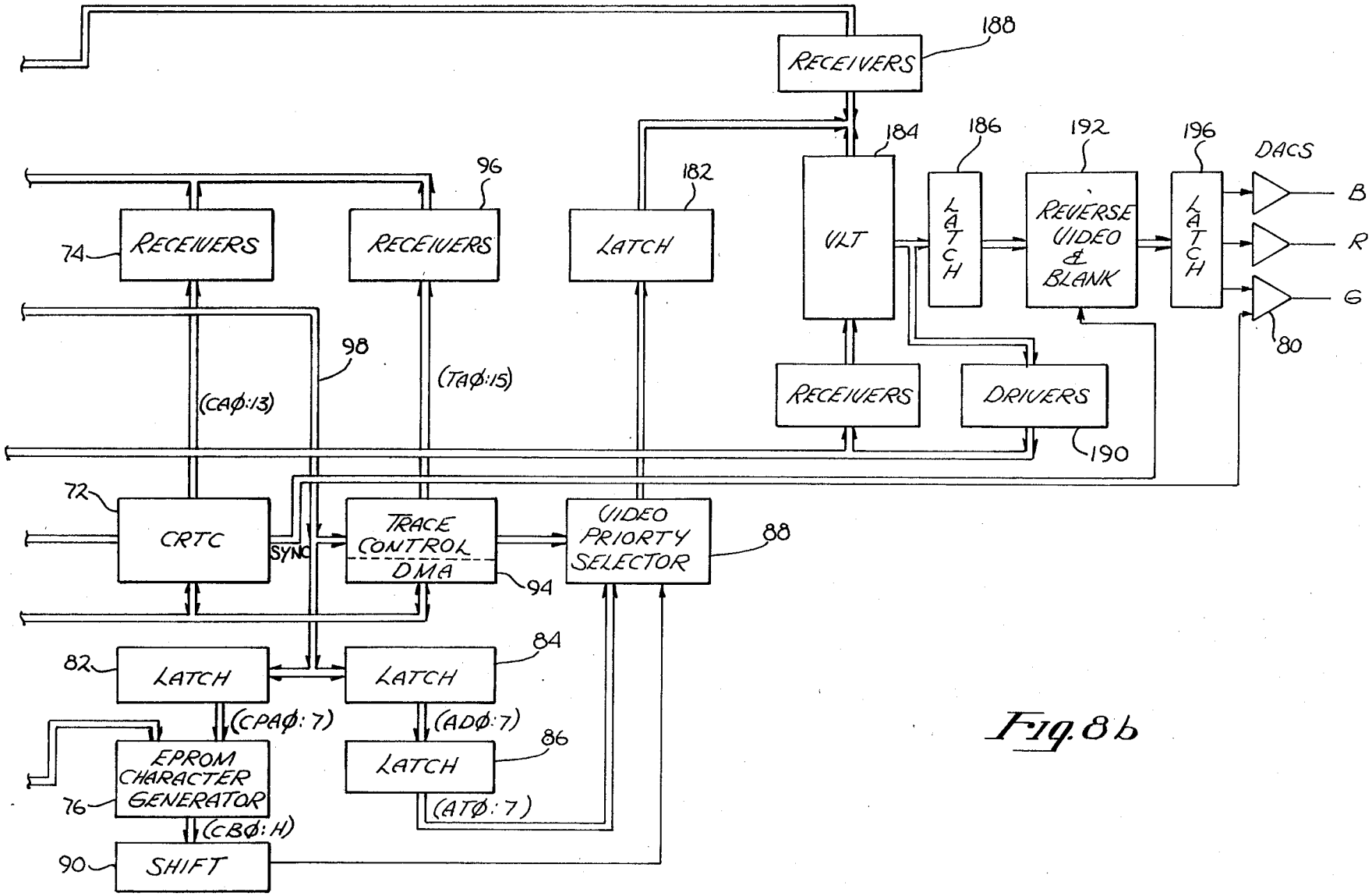
Figure 13:
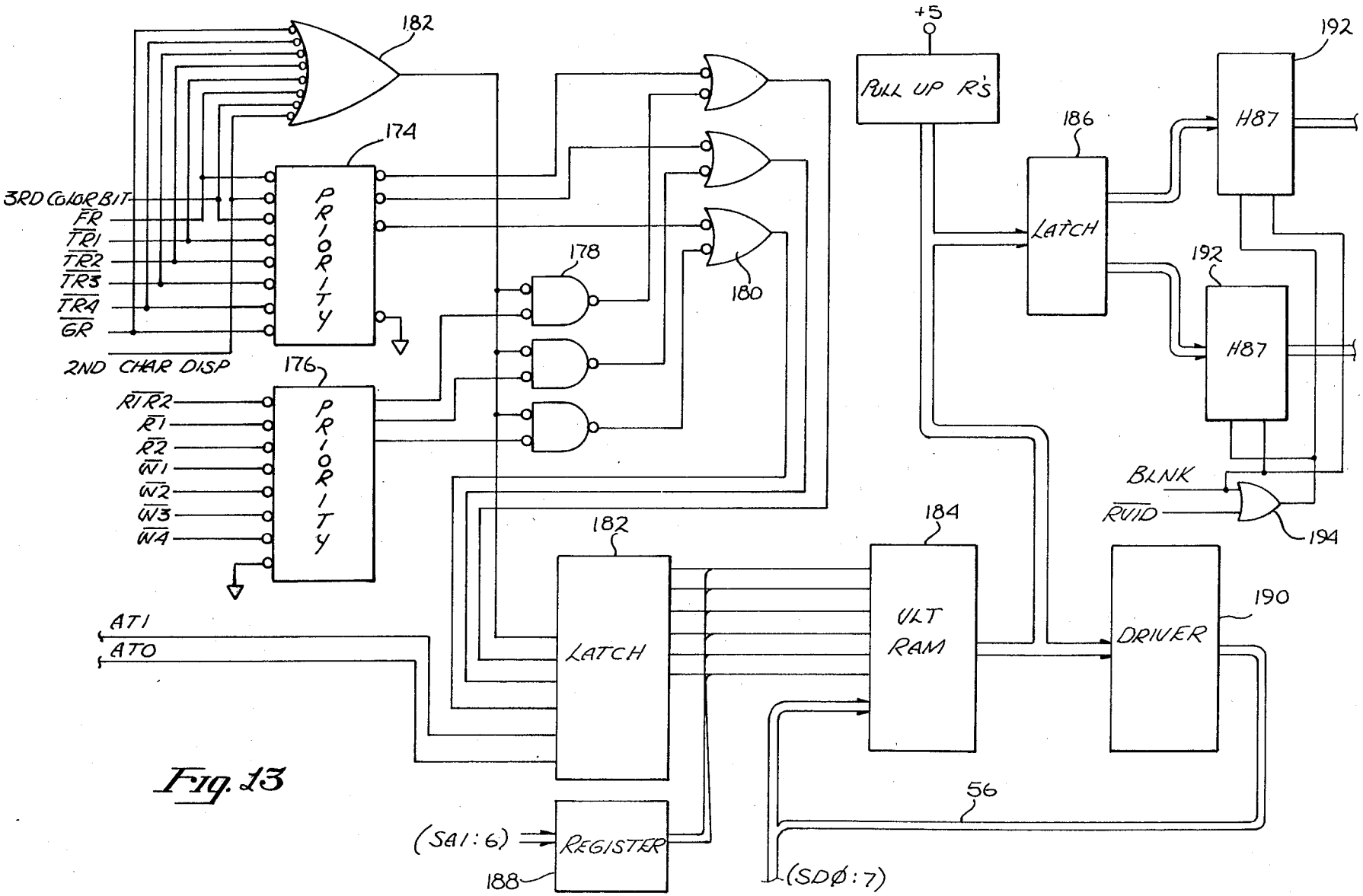
FIG. 13 is a circuit diagram of the priority selector, of the video look-up table and certain portions of the video circuit.

Now referring to FIG. 13 and also to FIG. 10, details of the video priority selector 88 of FIG. 8*b* and the remaining portion of that figure may be seen. The priority selector comprises 2 74148 8 line to 3 line priority encoders 174 and 176, cascaded through NAND gates 178 having inverted inputs, and OR gates 180 also having inverted inputs and OR gate 182 also having inverted inputs, to provide a 15 bit to 4 bit priority encoder circuit, the least significant bit of priority encoder 176 being tied to ground. The four bit output of the priority circuit is combined with bits AT0 and AT1 from latch 86 (FIG. 8*b*), the bits AT0 and AT1 representing the first two color bits in the alphanumeric character word. The four bits of the priority circuit and the two additional bits AT0 and AT1 are combined in latch 182 to provide a six bit address to the 93419 random access memory video look-up table 184, the output of which is then latched in latch 186 for controlling the video circuits. The video look-up table 184 of course may be loaded through the system data bus 56, using the system address bus for addressing purposes through receivers 188. The data loaded into the look-up table determines the color for each pixel dependent on the address thereto provided through the priority circuit. Drivers 190 are provided so that the video look-up table data may be read on the system data bus as well as loaded into latch 186 for video control purposes.

The 74148 priority encoders 174 and 176 are operative on negative logic input signals and accordingly, all of the inputs thereto are so marked. Neglecting for the moment the question of positive versus negative logic, it will be seen that the highest priority signal is the window frame signal FR, which therefore will be laid over any and all other displayed data. The second highest priority is the alphanumeric character bit, whereby alphanumeric characters will be laid over all other displayed information except for the window frames. In that regard it is to be remembered that the priority is determined for each and every pixel put up, so that the window frame signal FR will be active only when a pixel of a window frame is being put up, signal FR in fact causing the drawing of the window frame pixel. The third highest priority bit is the third color bit, essentially corresponding to bit AT2, the third color bit in the alphanumeric character word. The next four highest priority signals are the trace signals TR1 through TR4. With the specific priority assignment shown, if all four traces are displayed in a given window, trace 1 will overlie the other traces, trace 2 will overlie traces 3 and 4, etc.

The next priority signal is the grid signal GR (see FIG. 11 regarding the generation of this signal) which commands the drawing of a point of a vertical grid line. Because the traces themselves are given a higher priority than the grid lines, the grid lines will serve as background to the traces, as does conventional graph paper when a curve is drawn thereon. In that alphanumeric graphics characters and overlap the vertical grid lines.

The next highest priority signals in descending priority order are the signals R1 and R2 (again neglecting the negative versus positive logic signals). As was described with respect to FIG. 14, the signal R1 will be generated whenever the scan is above trace 1, the signal R2 generated whenever the scan is above trace 2, and the signal R1R2 whenever the scan is above both traces. In that regard, noting the priority assignment, the signal R1R2 has a higher priority than R1 and R2. Consequently, the order in which the signals come on will be first, either R1 or R2 will come on as one of the traces is crossed by the scan depending on which trace is crossed first, followed by R1R2 and the other of R1 and R2, which two addtional signals come on simultaneously when the second trace is crossed. Consequently, referring to FIG. 7 in relation to this discussion, assume that trace 1 is assigned color 5 in the video look-up Table 184 (see FIG. 8) and trace 2 is assigned color 6. For the vertical scan lines wherein trace 1 is below trace 2, signal R1 will first come on, so that once the line segment corresponding to trace 1 for that vertical scan is completed, presented as color 5, and assuming there are no higher priority signals such as a vertical grid line, the area above trace 1 will be filled in with line segments of color 1, as assigned to the signal R1 in the video look-up table. Of course when trace 2 is reached, the line segment corresponding to trace 2 of color 6 will be drawn, at which time all of the signals R1R2, R1 and R2 will come on, R1R2 having the highest priority to command color 4. If on the other hand trace 2 is lower than trace 1, R2 will come on first rather than R1 which, as may be seen in FIG. 7, has been arbitrarily assigned color 2. Finally, color 3 is the window background color. In that regard, the window frame itself may be a separate color though all window frames displayed simultaneously will be of the same color. In the preferred embodiment, the feature described with respect to FIG. 7 is provided only for traces 1 and 2 though obviously could be readily extended so that one could accomplish the same thing for traces 3 and 4, or for that matter for more than two traces in the same window if desired. The feature is effectively disabled by making colors 1, 2, 3 and 4 the same in the video look-up table. The remaining priority signals, again in descending order of priority, are the signals W1, W2, W3 and W4, which signals set the respective window background color.

The foregoing 15 signals are combined by the priority circuit to provide a 4 bit binary signal used as four bits of the address to address video look-up table 184 through latch 182, the remaining two bits of the address being provided by the least significant two bits of the alphanumeric character word, specifically the signals on lines AT0 and AT1. It may be seen, therefore, that depending on how one loads the video look-up Table 184, bits AT0 and AT1 essentially serve as a pointer to any one of four blocks of the video look-up table, each of which four blocks may define an individual color combination for the 15 signals otherwise combined by the priority circuit.

In that regard, in the preferred embodiment the video look-up table random access memory may be loaded through bits 0 through 7 of the system data bus using addresses on bits 1 through 6 of the system address bus. Also, if desired, the present contents of the video look-up table may be read through the system data bus through driver 190.

The output of the video look-up table 184 (see FIG. 13) is an 8-bit signal representing three bits of red information, three bits of green, and two bits of blue information, which 8-bit signal is passed to latch 186 (see also FIG. **8*b* for latching therein). The 8-bit output of the latch 186 is coupled to the reverse video and blanking circuit 192 comprised of a pair of H87 logic devices. These devices each have four input lines, four output lines and two control lines, with the four outputs being in any one of four states depending upon the state of the two control lines. In particular, the four output states are all four outputs held low, all four outputs held high, four outputs each being held at the complement of the respective one of the four inputs, and each of the four outputs being held at the state of the respective one of the four inputs. With the connection of the controls shown through OR gate 194, the blanking signal BLNK will cause all four outputs of each of the two H87's to be held low to blank out any signal otherwise generated by the graphics display system. The reverse video signal RVID, on the other hand, will cause the output of the H87 to represent the complement of the input, thereby effectively inverting the video signal when commanded. Actually in the preferred embodiment, the reverse video signal is generated by the CRTC 72 (FIG. 8) to provide a software controlled cursor which may be moved around the display as desired. Finally, as may be seen in FIG. 8*b*, the output of the reverse video and blanking circuit 192 is coupled through latch 196 to the digital to analog converters 80 to convert the three bits of red digital data to a red voltage level, three bits of green digital data to a green voltage level and the two bits of blue digital data to a blue voltage level through the digital to analog converts 80**. In the preferred embodiment, the blue, red and green voltage levels are separately coupled to the CRT display, the particular display being used being responsive to horizontal and vertical sync signals superimposed on the green voltage level.

In the preferred embodiment, vertical sweep is achieved by taking a conventional horizontal sweep high quality color monitor and rotating the display through 90 degrees (together, of course, with the focusing coils, etc. thereof). This provides two effects, both of which are advantageous in the preferred embodiment because of the nature of the information being displayed. In particular, vertical sweep is automatically achieved without making any electrical changes to the display itself, the horizontal ramp generator now becoming the vertical ramp generator and vice versa, the normal vertical retrace becoming the horizontal retrace.

The second advantageous effect is that the aspect ratio of the display, commonly wider than tall, now is reversed, so that a taller than wide display is achieved to readily accommodate the display of a plurality of traces one above the other, such as the four traces of the preferred embodiment.

In the preceding description, the data being displayed has been referred to as being run length or run time encoded. It should be noted, however, that really no special form of coding is required as substantially any digital data intended to be displayed will be received in the form of a list of binary coded coordinants for the data points to be displayed. By merely placing the information for each trace in a respective trace list in the present invention in the order of the x-coordinants, the y binary coded data points are already effectively fully run length encoded. Stated differently, run length encoding as effectively used herein with respect to the present invention merely means that the y-coordinant for each point on each trace is a binary coded number, with scrolling for any trace being accomplished by choosing and varying the trace data offset as described herein, and panning being achieved by choosing and varying the trace list start addresses during readout for display purposes. Accordingly, the terms run length encoded and binary coded as used herein and in the claims, are essentially alternative methods of describing the form of the data to be stored in memory for display.

Having now described the preferred embodiment of the invention in detail, some of the advantages of the invention over conventional bit mapped display systems may be highlighted. By way of example, in the preferred embodiment, the display contains 720 scan lines with each trace data word being a 16-bit or two byte word. Consequently, each trace requires 1440 bytes of random access memory storage, or for the four traces of the preferred embodiment, 7.6K bytes of memory. There is, of course, some additional storage capacity required to define the trace windows, alphanumeric characters, graphics characters, etc., which are provided by the two-byte alphanumeric character words. Only one such word is required, however, for each alphanumeric $9\times12$ character cell, so that the full screen description only requires an additional approximately 6.83K bytes of memory storage, making a full screen of four traces, four trace windows, alphanumerics, graphics characters and grid lines, all with any of 64 colors, only requiring approximately 12.6K of random access memory storage capacity. This is to be compared with a memory requirement of approximately 369K bytes in a fully bit mapped system to provide an 8-bit deep 720 by 512 memory plane to provide the color capability of the present invention, or almost 30 times the storage capacity. Further, as previously mentioned, with the present invention, while the display is only 720 lines wide, memory itself may readily be made many times that width to provide a wide area for panning as desired while still keeping the total memory size relatively small. By way of example, the display information which may be stored in 64K bytes in the present invention would normally require on the order of two megabytes in a bit mapped system. While two megabytes is definitely economically feasible with current technology and systems having such capacity are commercially available, the present invention may be fabricated at only a small fraction of the cost thereof. Further, the relatively low memory requirements of the present invention provides the additional advantage of speed, as the memory may be written into, altered, etc., very quickly because of the small amount of memory which must be changed. Consequently, the system of the present invention is very responsive to operator input and is not subject to the delays of seconds or even tens of seconds in bit mapped systems currently being used for display of information in graph form.

Obviously. while the preferred embodiment has been disclosed and described herein in detail, it will be understood by those of reasonable skill in the art that various changes in the form and detail may be made therein without departing from the spirit and scope thereof.

We claim:

1. In a graphics display system, the improvement comprising a raster scan display, said display being characterised by a vertical raster scan memory means for storing digital data to be displayed, said memory means being a means for storing said digital data wherein the relative vertical position of each data point to be displayed on each vertical raster scan is stored in binary coded form digital communication means coupled to said memory means for receiving digital data to be displayed from an auxiliary digital device in said binary coded form and coupling said digital data to said memory means video sync generation means for providing vertical and horizontal sync signals and for providing a pixel clock signal for each raster scan trace control means coupled to said memory means and said video sync generation means, said trace control means having an addressing means for addressing said memory synchronized to said vertical and horizontal sync signals to botain coded data to be displayed for each vertical raster scan, and a digital counter means responsive to said pixel clock signal for each scan to provide a digital trace signal indicative of a pixel clock signal counter corresponding to the coded data for that scan, and video generation means coupled to said digital counter means of said trace control means, said video sync generation means and said display, said video generation means being a means for providing a video signal to said display to display said data in graphic form responsive to said digital trace signal.

2. The improvement of claim 1 wherein said trace control means is a means for providing, for a plurality of vertical scans lines, a trace signal for said at least one trace to cause the display on each scan line of a first pixel corresponding to the data point for the respective scan line and a second pixel corresponding to the data point for an immediately adjacent scan line.

3. The improvement of claim 2 wherein each pixel of the display is approximately twice as high as it is wide.

4. The improvement of claim 2 wherein said trace control means is also a means for providing a trace signal to also cause the display of all pixels between said first and second pixels.

5. The improvement of claim 4 wherein said first and second pixels may sometimes overlie.

6. The improvement of claim 1 wherein said trace control means is a means for causing (a) for one scan line, the display of a first pixel corresponding to the data point for the respective scan line, a second pixel corresponding to the data point for an immediately adjacent scan line, and any and all pixels therebetween (b) for the next scan line, the duplication of the display displayed in step (a), and then (c) the successive repeat of steps (a) and (b) using the data points for each successive pair of scan lines whereby two adjacent lines displayed as defined by the respective first and second pixels may have starting and ending positions independent of other pairs of lines displayed.

7. The improvement of claim 1 wherein said trace control means is a means for providing for a plurality of vertical scans, a trace control signal for at least one trace to cause the display of a first pixel corresponding to the data point for the respective scan line, a second pixel corresponding to the data point for a different scan line and all pixels between said first and second pixels.

8. The improvement of claim 7 wherein said different scan line is two scan lines away from the current scan line.

9. The improvement of claim 7 wherein said different scan line is an adjacent scan line of the same field of an interlaced raster scan display.

10. The improvement of claim 7 further comprised of means for detecting peaks and valleys in the trace data values, and for the scan line of each peak and each valley, causing said trace control means to provide a trace control signal to cause the display of a first pixel corresponding to the data point for the respective scan line, a second pixel corresponding to the data point for the preceding scan line and all pixels between said first and second pixels.

11. The improvement of claim 1 wherein said memory means is a means for storing coded data for a plurality of traces, each trace being characterized by at least one data point stored in said memory means in binary coded form for each vertical raster scan line crossing the respective trace, whereby multiple traces may be simultaneously displayed.

12. The improvement of claim 11 further including means for allowing a first trace to overlie a second trace on said display.

13. The improvement of claim 12 further including means for filling in vertical lines between said first trace and said second trace with a color dependent upon which trace is lower than the other for the respective vertical line.

14. The improvement of claim 1 further comprised of an alphanumeric character generator for selectively presenting alphanumeric characters on the display.

15. The improvement of claim 14 further comprised of a graphic character generator for selectively presenting graphics characters on display.

16. The improvement of claim 15 further comprised of a priority means for setting the priority of data to be displayed to determine which displayed data overlies which other displayed data.

17. The improvement of claim 1 wherein said memory means is a means for storing coded data for at least one trace, and further comprised of means for causing the display of a trace window on said display, and wherein said trace control means provides a trace signal to cause the display in graphic form of only that data which when displayed falls within the window.

18. The improvement of claim 1 wherein said trace control means includes means for combining a variable offset to said binary coded data, whereby the display of data in graphic form may be scrolled by varying said offset.

19. The improvement of claim 1 wherein said memory means is a means for storing binary coded data for a number of vertical raster scan lines exceeding the number which may be displayed at any one time, and further including means for varying the start address of data to be displayed to pan across any part of the coded data stored in memory, whereby the graphic display will be caused to pan.

20. The improvement of claim 1 further comprising means for confining the range of said coded data to within the limits of the range of the decoding means.

21. In a graphics display system, the improvement comprising a raster scan display, said display being characterized by a vertical raster scan random access memory means for storing digital data to be displayed, said memory means being a means for storing said data representing horizontal and vertical coordinate pairs wherein the relative horizontal coordinates of the data points are logically ordered by associated random access memory means addresses and the relative vertical position of each data point to be displayed on the respective vertical raster scan is stored at the associated random access memory address in binary coded form, and for additionally storing other digitally coded information to be displayed digital communication means coupled to said random access memory means for receiving digital data to be displayed from an auxiliary data digital device and coupling said digital data to said memory means for storage therein video sync generation means for providing vertical and horizontal sync signals thereto and for providing a pixel clock signal for each raster scan trace control means coupled to said memory means and said video sync generation means, said trace control means having an addressing means for addressing said memory in said logical order synchronized to said vertical and horizontal sync signals to obtain coded data to be displayed for each vertical raster scan, and a digital counter means responsive to said pixel clock signal for each scan to provide a digital trace signal indicative of a pixel clock signal count corresponding to the coded data for that scan, generator means coupled to said video sync generation means and said random access memory means for generating additional digital display signals responsive to said other digitally coded information synchronized to said horizontal and vertical sync signals and said pixel count for each scan priority means coupled to receive digital inputs from said trace control and saidgenerator means to provide a prioritized digital output signal responsive to a predetermined priority between the multiple inputs thereto, and video generation means coupled to said priority means, said video sync generation means and said display for providing a video signal to said display responsive to the digital output of said priority means.

22. The improvement of claim 21 wherein said video generation means includes a video look-up table and the output signal of said priority means comprises an address to said video look-up table.

23. The improvement of claim 21 wherein said generation means is a means for generating display signals representative of alphanumeric characters stored in said random access memory in coded form.

24. The improvement of claim 21 wherein said generator means is a means for generating display signals representative of graphics characters.

25. In a graphics display system, the improvement comprising a raster scan display, said display being characterized by a vertical raster scan random access memory means for storing digital data to be displayed, said memory means being a means for storing said data representing horizontal and vertical coordinate pairs wherein the relative horizontal coordinates of the data points are logically ordered by associated random access memory means addresses and the relative vertical position of each data point to be displayed on each vertical raster scan is stored at the associated random access memory address in binary coded form, said memory means also being a means for storing alphanumeric character words digital communication means coupled to said random access memory means for receiving digital data to be displayed from an auxiliary digital device and coupling said digital data to said memory means for storage therein video sync generation means for providing vertical and horizontal sync signals thereto and for providing a pixel clock signal for each raster scan trace control means coupled to said memory means and said video sync generation means; said trace control means having an addressing means for addressing said memory in said logical order synchronized to said vertical and horizontal sync signals to obtain coded data to be displayed for each vertical raster scan, and a digital counter means responsive to said pixel clock signal for each scan to provide a digital trace signal indicative of a pixel clock signal count corresponding to the coded data for that scan, alphanumeric character generator means coupled to said video sync generation means, said trace control means also having an addressing means for addressing said memory synchronized to said vertical and horizontal sync and pixel signals to obtain alphanumeric character words therefrom and to couple said words to said alphanumeric character generator means, said alphanumeric character generator means being a means for generating digital display signals representative of alphanumeric characters responsive to alphanumeric character words presented thereto priority means coupled to receive digital inputs from said trace control and said alphanumeric generator means to provide a prioritized digital output signal responsive to a predetermined priority between the multiple digital inputs thereto, and video generation means coupled to said priority means, said video sync generation means and said display for providing a video signal to said display responsive to the digital output of said priority means.

26. The improvement of claim 25 wherein said alphanumeric character generator means is also a means for generating graphics characters.

27. A method of displaying data in graph form comprising the steps of (a) providing a raster scan CRT display having a vertical raster scan;

(b) storing digital data to be displayed in a memory wherein memory addresses represent a relative horizontal position of a data point and the relative vertical position of a data point is represented by a binary coded number stored at the respective memory address;

(c) storing character words in binary coded form representing characters to be displayed in a memory at memory locations associated with character cell locations on the display;

(d) for a plurality of vertical raster scans, fetching the binary coded number associated with that scan line from memory and generating a digital data display signal responsive to the vertical position of the raster scan line and the binary coded number;

(e) for a plurality of character cells crossed by the vertical raster scan, fetching the character word associated with each respective cell from memory and generating a digital character display signal responsive to the position of the raster scan within the associated cell;

(f) digitally combining, converting to a video signal and displaying the data display signal and the character display signal on the display.

28. The method of claim 27 wherein the characters represented by the character words include graphics characters which at least in part define at least one display window and wherein the data display signal is displayed only within one of the display windows.

* * * * *

UNITED STATES PATENT AND TRADEMARK OFFICE

CERTIFICATE OF CORRECTION

PATENT NO. : 4,586,036

DATED : Apr. 29, 1986

INVENTOR(S) : Thomason et al.

It is certified that error appears in the above-identified patent and that said Letters Patent is hereby corrected as shown below:

| COLUMN | LINE | DESCRIPTION |
|---|---|---|
| 14 | 4 | Between the words "the" and "output" insert --$\overline{R1R2}$--. |

Signed and Sealed this

Twenty-fourth Day of February, 1987

*Attest:*

DONALD J. QUIGG

*Attesting Officer* *Commissioner of Patents and Trademarks*